US007186450B2

(12) United States Patent
Foxon

(10) Patent No.: US 7,186,450 B2
(45) **Date of Patent: *Mar. 6, 2007**

(54) CONSTRUCTION OF PLAYING SURFACES

(75) Inventor: Stephen Alan Foxon, Broughton Astley (GB)

(73) Assignee: Nottinghamshire Sports & Safety Systems Limited, Oadby (GB)

( * ) Notice: Subject to any disclaimer, the term of this patent is extended or adjusted under 35 U.S.C. 154(b) by 296 days.

This patent is subject to a terminal disclaimer.

(21) Appl. No.: 10/816,390

(22) Filed: Mar. 31, 2004

(65) Prior Publication Data

US 2004/0247822 A1 Dec. 9, 2004

(30) Foreign Application Priority Data

Apr. 3, 2003 (GB) ..... 0307671.8

(51) Int. Cl.
*B32B 33/00* (2006.01)
*B32B 5/12* (2006.01)
*B32B 3/02* (2006.01)

(52) U.S. Cl. ..... 428/86; 428/95; 428/87; 428/96; 472/92; 472/94

(58) Field of Classification Search ..... 428/95, 428/86, 87, 17; 472/92, 94
See application file for complete search history.

(56) References Cited

U.S. PATENT DOCUMENTS 3,607,588 A 9/1971 Soehngen
3,616,126 A * 10/1971 Tungseth ..... 428/86
3,900,656 A 8/1975 Schmidt
4,044,179 A * 8/1977 Haas, Jr. ..... 428/17
4,301,207 A * 11/1981 Schomerus ..... 442/43
4,336,286 A * 6/1982 Tomarin ..... 428/17
4,364,331 A * 12/1982 Foenard ..... 119/526
4,497,853 A 2/1985 Tomarin
4,819,933 A 4/1989 Armond
5,183,438 A * 2/1993 Blom ..... 472/92
5,352,158 A * 10/1994 Brodeur, Jr. ..... 472/92
5,384,001 A 1/1995 Hoopengardner
5,453,150 A 9/1995 Hoopengardner
5,658,430 A * 8/1997 Drake et al. ..... 156/71
5,849,387 A * 12/1998 Drake et al. ..... 428/86
5,951,798 A 9/1999 Schmidt et al.
5,955,174 A 9/1999 Wadsworth et al.
5,976,645 A * 11/1999 Daluise et al. ..... 428/17
6,029,397 A * 2/2000 Motz et al. ..... 47/58.1 R (Continued)

FOREIGN PATENT DOCUMENTS

EP 0065622 10/1982

(Continued)

*Primary Examiner*—Cheryl A. Juska
(74) *Attorney, Agent, or Firm*—Baker Botts L.L.P.

(57) ABSTRACT

A playing surface structure includes a resin impregnated textile layer (1) having a resin bonded layer of particulate rubber (7) adherent to its undersurface and overlying a fibrous random pile mat (8) incorporating a random pile layer (9) and a relatively compact, resin impregnated backing layer (10).

13 Claims, 1 Drawing Sheet

U.S. PATENT DOCUMENTS

| | | | | |
|---|---|---|---|---|
| 6,035,577 | A * | 3/2000 | Motz et al. | 47/58.1 R |
| 6,066,388 | A | 5/2000 | Van Kerrebrouck | |
| 6,094,860 | A * | 8/2000 | Motz et al. | 47/58.1 R |
| 6,295,756 | B1 * | 10/2001 | Bergevin | 47/1.01 R |
| 6,472,041 | B1 * | 10/2002 | Burke | 428/86 |
| 6,846,545 | B2 * | 1/2005 | Thomas | 428/85 |
| 6,858,272 | B2 * | 2/2005 | Squires | 428/17 |
| 2002/0132099 | A1 * | 9/2002 | Squires | 428/220 |
| 2003/0039511 | A1 * | 2/2003 | Prevost | 405/36 |
| 2003/0168146 | A1 | 9/2003 | Wenstrup, et al. | |
| 2004/0180177 | A1 | 9/2004 | Ray, et al. | |
| 2005/0238433 | A1 * | 10/2005 | Daluise | 405/46 |

FOREIGN PATENT DOCUMENTS

| | | |
|---|---|---|
| EP | 0174755 | 3/1986 |
| EP | 0495332 | 7/1992 |
| WO | WO 87/07520 | 12/1987 |
| WO | WO 92/05317 | 4/1992 |
| WO | WO 93/07790 | 4/1993 |

* cited by examiner

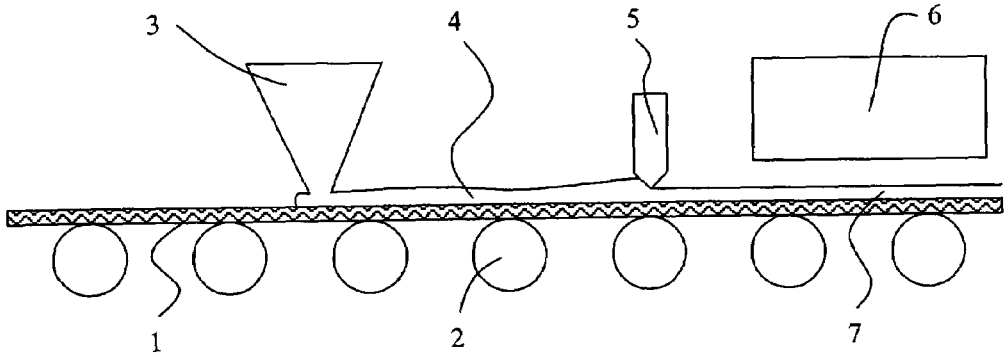
Fig. 1
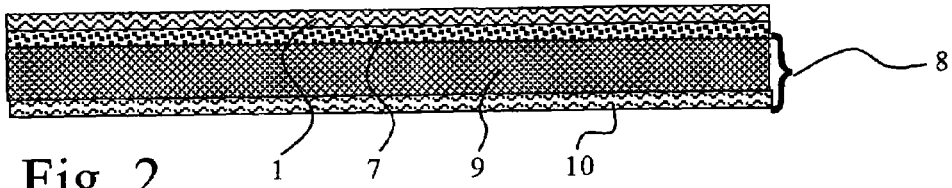
Fig. 2
Fig. 3
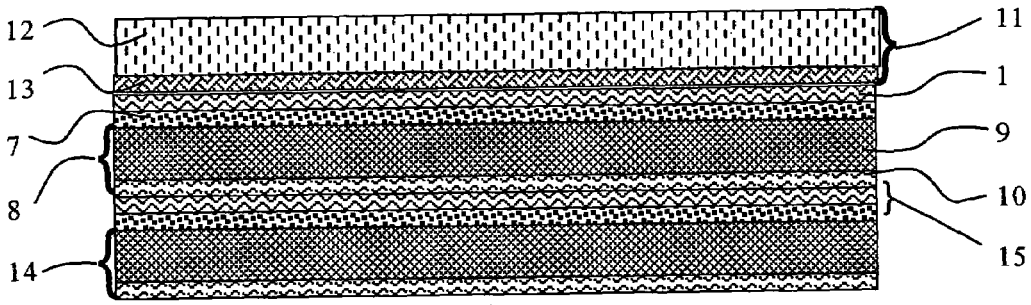
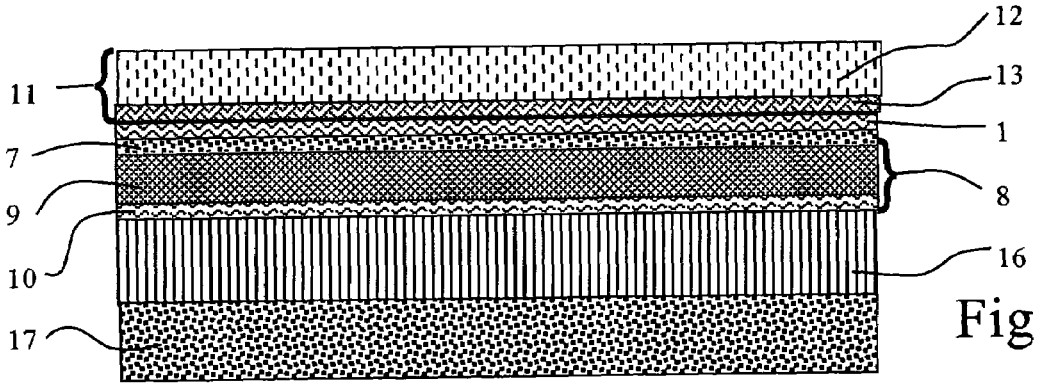
Fig. 4

CONSTRUCTION OF PLAYING SURFACES

CROSS REFERENCE TO RELATED APPLICATIONS

The present application claims benefit to Great Britain Application No. GB 0307671.8 filed Apr. 3, 2003.

TECHNICAL FIELD OF THE INVENTION

This invention relates to the construction of playing surfaces, in particular games playing surfaces, and the invention has particular, but not exclusive, reference to surfaces for playing outdoor games and sports including sports pitches and children's playgrounds.

BACKGROUND OF THE INVENTION

It is known to construct artificial games-playing surfaces over a substrate, for example of sand or gravel by applying a geotextile and a top layer of artificial turf to simulate natural performance characteristics. The use of particulate materials other than natural aggregates or combinations of both has also been proposed.

Desirable performance characteristics of the construction may vary widely depending on the primary intended use of the surface.

Impact absorbing surfaces (IAS) for playgrounds are now used in preference to concrete as they can reduce the chance of serious injury to or death of a child striking them.

A number of structures for these IAS are known, for example, layers of aggregate, typically Lytag™, and/or sand enclosed in a geotextile envelope and topped by a synthetic grass carpet layer. The layers of sand and aggregate are segregated by walls of the envelope in order to prevent depletion of regions of the structure due, for example, to repeated compression in regions subjected to much wear and/or impact such as under a swing, or due to the action of ground water or rain moving the aggregate and/or sand, or to protect the specialist aggregates from migration of 'foreign' materials from the sub-structure causing 'contamination' of the performance layers. Such compression, movement or contamination of the aggregate and/or sand degrades the performance of the IAS.

These structures have inherent practical and/or logistical problems associated with them such as the need to transport mineral aggregate infill to an installation site. Additionally, spillage of aggregate infill at an installation site is costly as spilled aggregate infill must be removed from the playing surfaces. Further to which in order to achieve a consistent surface layer it is necessary to have level aggregate infill and geotextile envelope structures and this requires labour intensive hand finishing.

Another IAS structure utilises a rubber granulate material which is screeded into and stabilised by a random pile layer which is usually overlain by a resin impregnated textile material. A synthetic grass carpet layer tops the textile material.

Attempts have been made to remove the need for aggregate infill by fabricating a playing surface underlay from multiple layers of a random pile material, for example a material known as vertical horizontal angular fibre (VHAF™) but this has limited applications.

Also, the use of bound rubber tiles or wetpour rubber is known. However, such systems can suffer from breakdown of resins used in the binding of the rubber over time and their performance can degrade accordingly.

Some playing surfaces, particularly children's playgrounds rather than games pitches, must fulfil a standard, the head injury criteria (HIC), which is the integral of the force, measured in G's, applied by a test piece, dropped from a known fall height (measured in meters) onto the playing surface, with respect to time (seconds), i.e. $\int F,dt$. The value of the HIC must not exceed 1000 at a given fall height if a playing surface is to be considered appropriate for use at that fall height. A measure of the critical fall height (CFH) is the height at which the HIC reaches a value of 1000. The height at which the maximum force exerted exceeds 200 G can also be taken as a measure of the CFH.

Some playing surface structures must therefore have impact absorbing properties, but at the same time they must not present a surface which is unnaturally soft for a user to walk on with an attendant risk of giving rise to twisting injuries to a user's ankle, or injuring the user in some other manner.

Thus there can be a conflict between the requirements for avoiding impact injuries to users' heads and the requirements for achieving a firm footing.

Hockey and football playing surfaces also require to be shock absorbing to some extent, partly for player comfort, but also for controlling the playing characteristics of the pitch, and they are tested to be shock absorbing to different degrees. Sand and stone are inherently shock absorbing but with limitations; this property improves when displacement of the particles occurs, but this is not always a satisfactory outcome as the level of the area may be disturbed, and it is known to provide a shock pad layer.

Most conventional shock pad layers have a degree of elasticity. We produce a shock pad layer consisting of a fibre shock pad and loose rubber granules. This is very effective, but can be costly to construct as the granules are spread by hand and it is labour intensive. More rubber and larger particles could be used within an envelope rather than in the shock pad. Problems with larger loose rubber crumb are that if it is disturbed, it does not self-level the in same way as sand or finer crumb.

Further problems can arise when screeding a thin layer of rubber particles for forming an outdoor playing surface even when they are stabilised by a fibre shock pad. The application of such particles is disturbed by any adverse weather conditions during the laying: even a light breeze makes it difficult to lay an even layer of rubber particles, and the layer could easily be further disturbed by the positioning of any overlying layer such as a layer of artificial turf without the most careful working procedures.

In order to decrease the cost of incorporating a layer of rubber, it would be possible for this rubber layer to be applied by rolling out a rubber mat or applying a layer of rubber tiles. Unfortunately however, the use of such rubber tiles and mats has certain disadvantages for use in outdoor playing areas in that if the rubber is made thick enough to withstand handling without damage, it on occasion can either be rather impervious to water, in which case the playing area may become waterlogged after rain, or the rubber can swell due to the absorption of rainwater and this tends to disturb the evenness of the playing surface. Problems can also arise in laying such rolls or tiles in such a manner as to achieve consistent joints between successive elements.

SUMMARY OF THE INVENTION

It is a principal object of the present invention to avoid or at least reduce the disadvantages referred to, and to provide a multi-layered playing surface structure which can be arranged to provide a highly satisfactory compromise between achieving an adequate critical fall height or impact absorption while maintaining a reasonably firm footing and which still allows modification of the properties of the surface structure in order to construct playing surfaces for different sports and games.

According to the present invention, there is provided a playing surface structure which includes a resin impregnated textile layer having a resin bonded layer of particulate rubber adherent to its undersurface and overlying a fibrous random pile mat incorporating a random pile layer and a relatively compact, resin impregnated backing layer.

We have found that such a structure can impart excellent firmness of footing to a playing surface structure without damaging impact absorbing properties. Because the rubber particles are bonded, they are less easy to displace than loose particles, and this allows a better control of the properties of the structure and contributes to a long useful life. Furthermore, we have found that the use of a resin impregnated textile layer can promote stiffening of the surface of the structure thus contributing to a high CFH by reducing impact contact time without necessarily reducing shock absorbency. Because the particulate rubber layer is bound to a textile layer, it can be applied thereto under easily-controlled factory conditions and thus more easily, reliably and reproducibly, and more evenly than under field conditions. It is to be noted, however, that the invention does not exclude the provision of a layer of loose rubber particles beneath the resin impregnated textile layer and bonded layer of particulate rubber should this be desired for some particular reason.

In the most preferred embodiments of the invention, the resin impregnated textile layer is covered by a surface carpet layer. Sections of such surface carpet layer may be joined together by under-seaming, for example using a hot-melt adhesive tape. Systems for hot-melt under-seaming are well known from the domestic carpet laying industry. We have found that the use of a resin impregnated textile layer in accordance with the invention affords particular advantages in protecting underlying rubber particles from melting or charring when such a hot-melt seaming technique is adopted.

In some preferred embodiments of the invention, such surface carpet layer has a pile laden with particulate material, preferably sand. Such sand may be present in amounts between 5 and 40 kg/m$^2$. The surface carpet layer may alternatively, or in addition, be laden with rubber particles, for example in an amount between 0.5 and 4 kg/m$^2$.

Advantageously, the random pile layer is laden with particulate material which may, for example, be sand or rubber.

The resin bonded layer of rubber particles is suitably up to 10 mm in thickness, containing rubber in amounts of 0.5 to 4 kg/m$^2$.

The rubber particles used may be obtained by comminuting vehicle tires.

In some preferred embodiments of the invention, the structure incorporates a second fibrous random pile mat beneath the first. This can promote impact resistance. Such second fibrous random pile mat can be the same as, or different from, the first, and it can be laden (or not) with the same or different particle material, in a same or different amount. Either or both such random pile matting may be constructed in accordance with EP 0 174 755.

A second rubber-backed textile layer may be incorporated between the two random pile mats if desired. This optional second textile layer may have identical properties to the first, or it may have different properties.

The structure of the present invention may with advantage be incorporated within a structure made according to our co-pending European Patent Application No EP 03257849.4.

Alternatively, the structure of the present invention may with advantage be incorporated into a structure made according to our co-pending European Patent Application No. EP 03252229.4.

BRIEF DESCRIPTION OF THE DRAWINGS

Preferred embodiments of the invention will now be described with reference to the accompanying diagrammatic drawings in which:

FIG. 1 is a diagrammatic illustration of an apparatus for forming a resin-bound particulate rubber layer on a textile web;

FIGS. 2, 3 and 4 are diagrammatic cross sectional views of two embodiments of playing surface in accordance with the invention.

DETAILED DESCRIPTION OF THE INVENTION

In FIG. 1 a textile web 1 is carried by a conveyor 2 beneath an applicator 3 where a fluid layer 4 of rubber particles in a resin binder is applied. The web passes beneath a doctor blade 5 where this fluid layer is levelled and its thickness regulated, and thence beneath an appropriate curing device 6 where the fluid layer is cured to become an adherent resin bound layer of rubber particles 7.

The resin bonded layer of rubber particles is suitably up to 10 mm in thickness, containing rubber in amounts of 0.5 to 4 kg/m$^2$.

In FIG. 2, a playing surface structure includes a resin impregnated textile layer 1 having a resin bonded layer of particulate rubber 7 adherent to its undersurface and overlying a fibrous random pile mat 8 incorporating a random pile layer 9 and a relatively compact, resin impregnated backing layer 10.

In FIG. 3, the resin impregnated textile layer of FIG. 1 is covered by a surface carpet layer 11 having a pile 12 and a backing 13. The surface carpet layer pile 12 is suitably laden with particulate material, such as sand in an amount of 20 kg/m$^2$.

The structure further incorporates an optional second fibrous random pile mat 14 beneath the first, and an optional second rubber-backed textile layer 15 is also incorporated between the two random pile mats 8, 14. The second fibrous random pile mat 14 may be substantially identical to the first 8, and the second rubber-backed textile layer 15 may be substantially identical to the first rubber-backed textile layer 1, 7.

The random pile layer 9 of the random pile mat 8 is laden with particulate material, namely rubber in an amount between 0.5 and 4.0 kg/m$^2$, suitably 2.0 kg/m$^2$. The random pile layer of the second random pile mat 14 may also be laden with the same or a different particulate material in the same or a different amount depending on the results to be achieved. The rubber particles used may be comminuted vehicle tires.

In FIG. 4, a single random pile mat 8 is used, and this overlies a vertically lapped layer of stratified fibrous material 16 lying on a substrate 17 which may be concrete, sand or stone, or simply a cleared surface of local ground to form a structure in accordance with our said co-pending European Patent Application No. EP 03252229.4.

Specific properties of various components of a playing surface structure are given in the following tables. Materials are manufactured in line with standard manufacturer's tolerances of plus or minus 10% on weights and manufacturing measurements. Any roll sizes in width and length are subject to plus or minus 1.25%.

TABLE 1

(Surface Carpet)

| | |
|---|---|
| Fibre | 110/18 Denier UVF Polypropylene |
| Blend | 75% at 110 denier, 25% at 18 denier |
| Fibre Weight | 1150 gms/sqm |
| Total Weight | 1380 gms/sqm |
| Total Thickness | 16–18 mm. (Pile height above backing 12–14 mm) |
| Manufacture | Needle-punched with resin impregnation to backing. |
| Bonding | Back-coated with SBR compound plus cross linking agent. |
| Coating | At 20% pick up gives 230 gsm |
| Backing Thickness | 4 mm |
| Flammability | Hot Nut BS4790 - Low Char Radius NBS Radiant Panel - Category 1 usage |
| Wearability (LISSON TRETARD) | Pile loss after 1,000 passes 4.4 mm 3,000 passes 4.7 mm |
| Porosity | Approximately 5200 mm/hr |

TABLE 2

(Sand)

| Aperture | B.S.S. | Percentage by weight retained | | |
|---|---|---|---|---|
| | | Typical Grading | | Cumulative |
| mm | MESH No. | Fractional | Cumulative | Range |
| 1.00 | 16 | TRACE | TRACE | NIL–0.5 |
| 0.71 | 22 | 2.5 | 2.5 | NIL–10 |
| 0.60 | 25 | 19.5 | 22.0 | 5–45 |
| 0.50 | 30 | 27.5 | 49.5 | 30–70 |
| 0.355 | 44 | 35.5 | 85.0 | 60–95 |
| 0.25 | 60 | 11.5 | 96.5 | 90–100 |
| 0.18 | 85 | 3.0 | 99.5 | 95–100 |

TABLE 3

(Textile)

| | |
|---|---|
| Fibre (Film) | Polyester |
| Fibre denier | 6 to 120 |
| Colour | White |
| Film Weight | 270 gms/m.sqr. (not less than) |
| Film Thickness | 1–2 mm |
| Film Manufacture | Needlepunched with resin binding |
| Film Porosity | 501/s/m |
| Film Stiffness | Test method NCC/SFAL not less than, nil. No more than |
| Film Tensile Properties | BS6906 Part 1 1987 Not less than 6.0 kn/m |
| Film Elongation Peak load | No more than 70% |
| Ability of Film to resist silting up | Test method NS/PLK04 Surface layer, no greater than 3 mm Infiltration rate, no less than 40 mm per hour after |
| Backing Type | 1–8 mm (uncompacted) bonded rubber crumb granules- SEE TABLE 5 for EXAMPLE DETAIL OF GRANULES |
| Backing Weight | 0.5 to 3 kg $m^2$ |

TABLE 3-continued (Textile)

| | |
|---|---|
| Total Weight | 0.17 to 3.27 kg $m^2$ |
| Total Thickness | 3–10 mm (un-compacted) |

TABLE 4

(Random pile mat VHAF ™)

| | |
|---|---|
| Fibre | 110/18 Denier Polypropylene |
| Blend | 75% at 110 denier, 25% at 18 denier |
| Fibre Weight | 1150 gms/sqm |
| Total Weight | 1380 gms/sqm |
| Total Thickness | 18 mm. (Pile height above backing 12–14 mm) |
| Manufacture | Needle-punched with resin impregnation to backing. |
| Bonding | Back-coated with SBR compound plus cross linking agent. |
| Coating | At 20% pick up gives 230 gsm |
| Backing Thickness | 4 mm |
| Flammability | Hot Nut BS4790 - Low Char Radius NBS Radiant Panel - Category 1 usage |
| Wearability (LISSON TRETARD) | Pile loss after 1,000 passes 4.4 mm 3,000 passes 4.7 mm |
| Porosity | Approximately 5200 mm/hr |

TABLE 5

(Rubber particulate)
Tyre rubber granulate

| Type/Name of Material: | |
|---|---|
| Main Range of Particles: | 0.50 mm to 1.50 mm |
| Breakdown of Particle Range: | |
| 0.50 mm | 5% to 35% |
| 1.00 mm | 30% to 60% |
| 1.40 mm | 5% to 40% |
| Material Analysis: | |
| Total polymer content (natural & synthetic rubbers) | 56% minimum |
| Acetone Extract | 9% to 20% |
| Carbon black | 25% to 35% |
| Ash at 550° C. | 8% max |
| Sulphur | 1% to 3% |
| Hardness | 60–79 IRHD |

TABLE 6

(Stratified Fibrous Material)

| | |
|---|---|
| Manufacture | The fibre layer will be of vertically lapped textile construction on a Struto manufacturing machine laminated to a backing scrim |
| Fibre | 70% Polypropylene/30% Bi-Com Polyester |
| Denier | 5 to 110 |
| Fibre Weight | Not less than 1650 gms/sqm |
| Backing Scrim Weight | 100 gms/sqm |
| Total Thickness | 20 mm |
| Backing | 100% polypropylene woven scrim |

It will be appreciated that by "rubber" is meant one or more of natural rubber, or something containing natural rubber; synthetic rubber, or something containing synthetic rubber; a resistant force-absorbing material that can take the place of rubber in use, such as a resilient plastics, or polymeric material. Limitation to natural rubber is not intended for many embodiments, although some embodiments may use natural rubber.

Similarly, references to "sand" may in many embodiments refer to "proper" sand since this is cheap and durable and well-tried by us in experiments, but should not in other embodiments be viewed as restrictive. Another particulate material replacement for sand many be envisaged, for example another small-sized incompressible, or substantially incompressible particulate material, possibly having a uniform particle size or possibly having a range of particle sizes: something that can take the place of sand in use and perform comparably.

The invention claimed is:

1. A playing surface structure which includes a resin impregnated textile layer having a resin bonded layer of particulate rubber adherent to its undersurface and overlying a first fibrous random pile mat incorporating a random pile layer and a relatively compact, resin impregnated backing layer.

2. A playing surface structure according to claim 1, wherein the resin impregnated textile layer is covered by a surface carpet layer.

3. A playing surface structure according to claim 2, wherein said surface carpet layer has a pile laden with particulate material.

4. A playing surface structure according to claim 3, wherein said particulate material comprises sand in an amount between 5 and 40 kg/m$^2$.

5. A playing surface structure according to claim 1, wherein the random pile layer is laden with particulate material.

6. A playing surface structure according to claim 5, wherein the random pile layer is laden with rubber in an amount between 0.5 and 4.0 kg/m$^2$.

7. A playing surface structure according to claim 1, wherein the resin bonded layer of rubber particles has a thickness of the order of, or up to 10 mm, and contains rubber in amounts of 0.5 to 4 kg/m$^2$.

8. A playing surface structure according to claim 1, wherein the rubber particles used are from comminuted vehicle tires.

9. A playing surface structure according to claim 1, wherein the structure incorporates a second fibrous random pile mat beneath said first fibrous random pile mat.

10. A playing surface structure according to claim 9, wherein a second rubber-backed textile layer is incorporated between the two random pile mats.

11. A playing surface structure which includes a resin impregnated textile layer having a resin bonded layer of particulate rubber adherent to its undersurface and overlying a first fibrous random pile mat incorporating a random pile layer and a relatively compact, resin impregnated backing layer, wherein the resin impregnated textile layer is covered by a surface carpet layer having a pile laden with sand in an amount between 5 and 40 kg/m$^2$, and wherein the random pile layer is laden with rubber in an amount between 0.5 and 4.0 kg/m$^2$.

12. A playing surface structure which includes a resin impregnated textile layer having a resin bonded layer of particulate rubber adherent to its undersurface and overlying a first fibrous random pile mat incorporating a random pile layer and a relatively compact, resin impregnated backing layer, wherein the resin impregnated textile layer is covered by a surface carpet layer having a pile laden with sand in an amount between 5 and 40 kg/m$^2$, and wherein the random pile layer is laden with rubber in an amount between 0.5 and 4.0 kg/m$^2$, and wherein said resin bonded layer of rubber particles is up to 10 mm in thickness, containing rubber in amounts of 0.5 to 4 kg/m$^2$.

13. A playing surface structure which includes a resin impregnated textile layer having a resin bonded layer of particulate rubber adherent to its undersurface and overlying a first fibrous random pile mat incorporating a random pile layer and a relatively compact, resin impregnated backing layer, wherein the resin impregnated textile layer is covered by a surface carpet layer having a pile laden with sand in an amount between 5 and 40 kg/m$^2$, and wherein the random pile layer is laden with rubber in an amount between 0.5 and 4.0 kg/m$^2$, and wherein said resin bonded layer of rubber particles is up to 10 mm in thickness, containing rubber in amounts of 0.5 to 4 kg/m$^2$, said structure incorporating a second fibrous random pile mat beneath said first fibrous random pile mat, and a second resin impregnated textile layer having rubber particles adherent to a surface is incorporated between said first and second random pile mats.

* * * * *